United States Patent [19]

PerDue

[11] 3,976,252

[45] Aug. 24, 1976

[54] CHOPPING MACHINE

[75] Inventor: James E. PerDue, Madison, Ohio

[73] Assignee: The General Tire & Rubber Company, Akron, Ohio

[22] Filed: July 28, 1975

[21] Appl. No.: 599,552

[52] U.S. Cl. ..... 241/46.02; 241/46.11; 241/185 A; 241/243

[51] Int. Cl.[2] ..... B02C 23/36

[58] Field of Search ..... 241/46.02, 46.06, 46.11, 241/46.17, 185 R, 190, 243

[56] References Cited

UNITED STATES PATENTS

| | | | |
|---|---|---|---|
| 2,241,587 | 5/1941 | Dardin, Jr. | 241/46.06 |
| 2,273,405 | 2/1942 | Hoehn | 241/73 |
| 3,738,581 | 6/1973 | Galluresi et al. | 241/46.02 |
| 3,786,996 | 1/1974 | Richter | 241/46.17 |
| 3,815,827 | 6/1974 | Bradley | 241/46.11 |

*Primary Examiner*—Granville Y. Custer, Jr.

[57] ABSTRACT

A rotatable machine for chopping or comminuting lumps, curds or chunks of material into particles or pieces of acceptably smaller size adapted for permanent installation in a liquid flow line. Includes an internal chopping combination of rotatable and stationary blades intersecting the flow path of the flow line and adapted to be removed, repaired or completely rebuilt, and replaced without the consequent time, labor and expense of removing the main body from the flow line.

10 Claims, 5 Drawing Figures

CHOPPING MACHINE

BACKGROUND OF THE INVENTION

This invention generally pertains to machines for chopping or comminuting lumps carried with a liquid into pieces of acceptably smaller size which can be subsequently removed from the liquid or disposed of along with the liquid. More particularly, this invention pertains to a rotatable chopper adapted for mounting directly in the line of a process pipe or conduit to chop all lumps passing through the pipe into acceptable size.

The nearest presently known prior art appears in U.S. Pat. No. 2,273,405 which shows a rotary type of disintegrating mill suitable to make a puree of foodstuffs and the like and in U.S. Pat. No. 3,439,361 which shows a rotary type sewage comminuting apparatus.

SUMMARY OF THE INVENTION

The present invention provides a rotary chopper which may be installed as a permanent component of a process pipe or line and be completely repairable or rebuildable without disturbing the process line piping which may be flanged, welded or the like.

The present invention also provides apparatus having a plurality of interchangeable rotatable and stationary operating components which may be fabricated simply and in quantity as spare and replacement parts.

The present invention provides a chopping apparatus adapted to chop lumps flowing into the apparatus with substantially constant torque requirements throughout complete rotation of the chopping elements.

Other provisions and advantages of the invention will become more apparent in the detailed description of a rotatable chopping machine including a hollow body defining two conduit ends adapted for fixed connection into a flow line and defining a cylindrical bore fully intersecting the flow path between the conduit ends. The cylindrical bore has closure caps at both its ends with at least one of said caps being a removable cap to the full diameter of the bore and a rotatable shaft extending axially through the bore, through one of said closure caps and adapted for rotation by an external power source. A plurality of elongated rotatable cutter blades are transversely fastened in splined relation to the shaft to rotate with the shaft with each rotatable blade being angularly displaced on said shaft with respect to each adjacent rotatable blade and with each said rotatable blade extending near to the wall of the bore. A plurality of elongated stationary cutter blades are mounted in journaled relation on the shaft with each said stationary cutter blade being disposed adjacent a rotatable cutter blade and extending to the wall of said bore with the total combination of the rotatable blades and the stationary blades being adapted to effectively intersect the complete flow path between the conduit ends. A retainer means within said bore is adapted to retain said stationary cutter blades against rotation. The assembly of the removable cap, the shaft, the rotatable cutter blades and the stationary cutter blades are all removable from the body and replaceable in said body with individual parts being repaired or replaced as necessary.

DESCRIPTION OF THE PREFERRED EMBODIMENT

The present embodiment is typified as being utilized in the reaction product discharge pipe of a polyvinyl chloride reactor where the discharged reaction product includes lumps which are reduced in size to properly pass through valves, pumps, separators and the like.

Figure 1:
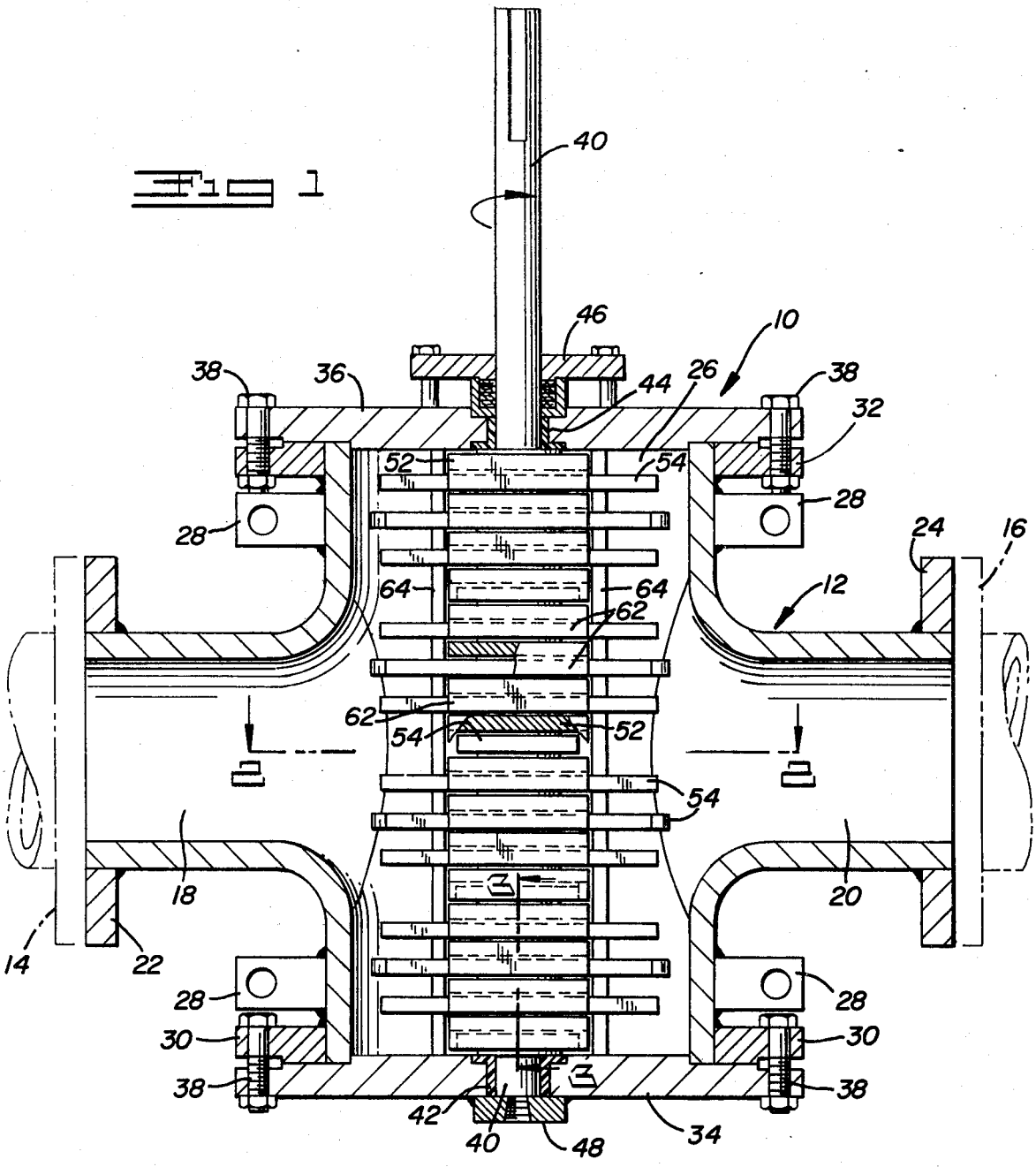
FIG. 1 is a partly plan partly sectional view taken along the axes of the flow conduit bores and the intersecting bore which houses the shaft and chopper blades as later described.

Referring to FIG. 1, the rotary cutter or chopper 10 of the present invention is shown with its generally hollow housing or body 12 connected into a process pipe line through process pipe flanges 14 and 16. Body 12 defines flow conduits 18 and 20 terminating in flanges 22 and 24 which are connected to pipe flanges 14 and 16 by means of gaskets and suitable fasteners (not shown) such as studs and nuts for example. The conduits 18 and 20 may also be connected into the process line pipe with welded or threaded connections as desired.

The body 12 defines a cylindrical bore 26 which intersects the fluid flow path between conduits 18 and 20.

The four support lugs 28 as shown on the body 12 may be provided to mount the body 12 to a suitable support base or bracket (not shown) which may also be used to mount the power unit (not shown) utilized to drive the chopper 10.

The body 12 is provided with flanges 30 and 32 at the ends of bore 26 to which are attached in sealed relation covers or caps 34 and 36 by means of fasteners 38 such as bolts. Caps 34 and 36 could also be attached by threaded connection under some conditions. Also, as will become evident, only one of caps 34 or 36 is required to be removable although providing both caps as being removable is more convenient for the embodiment shown.

A rotatable shaft 40 extends axially through the cylindrical bore 26 and through one of the caps such as cap 36 as shown. Shaft 40 is journaled in centered relation within bearings 42 and 44 mounted respectively in each cap as shown. A fluid packing or stuffing assembly 46 is provided on the cap through which shaft 40 extends, such as on cap 36 in FIG. 1, to prevent escape of liquids from within body 12 about the shaft. As shown a cap 48 having a threaded hole for a plug (not shown) is attached to cap 34 outside bearing 42 as a convenience in manufacture and maintenance.

Figure 2:
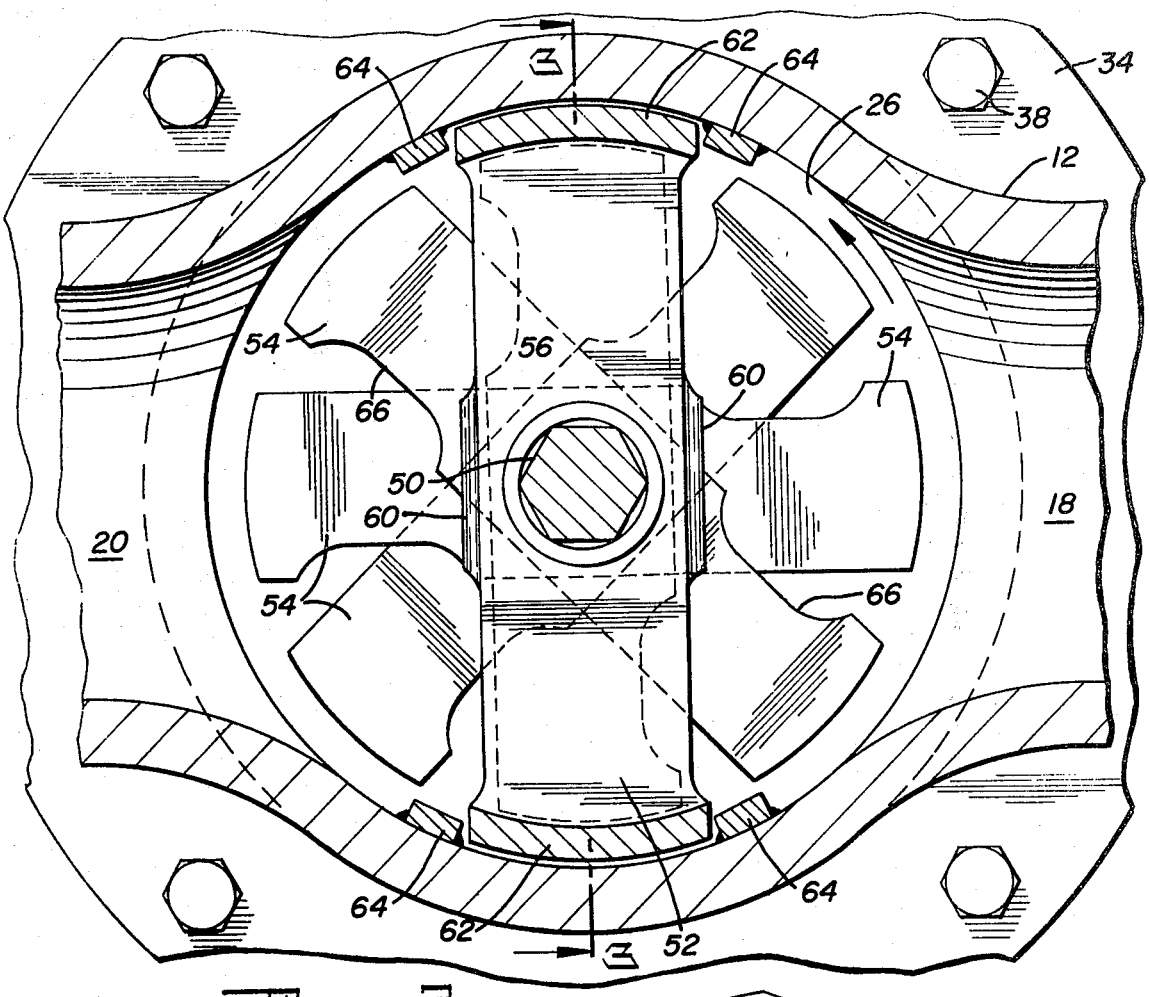
FIG. 2 is a partly sectional elevational view taken along the line 2—2 shown in FIG. 1 and showing the angular relationship of the cutter blades.
Figure 3:
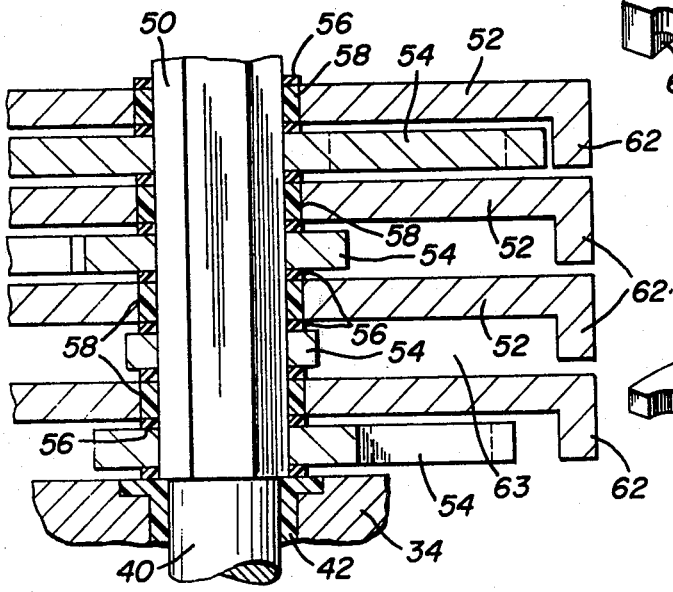
FIG. 3 is a partial sectional view taken along the line 3—3 as shown in FIGS. 1 and 2.

In comparing FIGS. 1–3, it is seen that shaft 40 is round at its ends where it is journaled in bearings 42 and 44 and through packing 46 but is polygonal through its length between the bearings 42 and 44, depicted in FIGS. 2 and 3 as being hexagonal in shape at portion 50.

Figure 4:
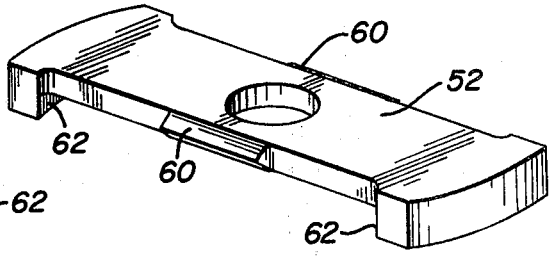
FIG. 4 is a perspective view of a stationary cutter blade of the apparatus.
Figure 5:
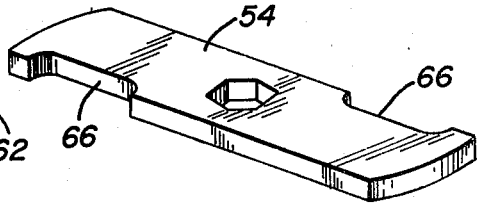
FIG. 5 is a perspective view of a rotatable cutter blade of the present apparatus.

As shown in FIG. 3, stationary cutter blades 52 (FIG. 4) and rotatable cutter blades 54 (FIG. 5) are alternately mounted along the hexagon portion 50 of shaft 40 and adjacently spaced apart with spacer bearings 56. As shown in FIGS. 3 and 4 the stationary cutter blade is provided with a round center hole which receives a journal bearing 58 which fits about hexagon portion 50 and allows the shaft 40 to rotate within the stationary blade 52. As shown in FIGS. 3 and 5, the rotatable cutter blade 54 is provided with a center hole of shape which registers in splined relation on hexagon portion 50 of shaft 40 and is adapted to be driven in rotation by the shaft 40.

The center edges of stationary blades 52 may be sharpened as at 60 to facilitate passage of lumps between the stationary blades. The ends of stationary blades may also be provided with axially extended flanges 62 into which the rotatable blades nest into as shown in FIGS. 2 and 3. With the nesting arrangement as shown in FIG. 3 the largest piece of a lump which can pass through the chopper will be no larger than the passage areas such as defined at 63.

The leaing edges of rotatable blades 54 are defined somewhat of scythe shape as at 66 on FIG. 5 to help catch and engage lumps passing through the cutter 10 for chopping into sizes passable through passage areas 63.

As seen in FIGS. 1, 2 and 3, the adjacent rotatable cutter blades 54 are mounted in angularly displaced relation on hexagonal section 50 of shaft with each blade 54 being at 60°, for example, relative to the next blade 54. Such angular displacement is helpful to distribute the fluid flow through the cylindrical bore 26, to distribute the lumps to be chopped and to stabilize the resulting torque required to rotate shaft 40.

Stationary cutter blades 52 are shown in FIGS. 2 and 3 to be restrained in stationary non-rotating position within body 12 by a pair of retainer guide lugs 64 which are mounted in parallel relation along the wall of cylindrical bore 26 and parallel with the axis of the bore. Other retaining means may be provided but the retainer lugs 64 and 66 as shown are convenient to fabricate and facilitate installation and removal of the assembly of the shaft 40, cap 36, and cutter blades 52 and 54 as is evident. It is to be noted that the stationary blades 52 extend close to the wall of bore 26 and the rotatable blades 54 extend close to the internal walls of flanges 62 of the blades 52. Thus all particles must pass through an area not larger than a passage area 63.

As a matter of perspective, the rotary cutter 10 was first manufactured and installed in the reaction product discharge line pipe of a polyvinyl chloride reactor. The discharged reaction product contains lumps of sizes too large to properly pass through valves, pumps, separators and the like. The rotary cutter 10 serves to reduce such lumps into sizes which can be further processed conveniently.

As an example, the rotary cutter 10 may have flow conduits 18 and 20 of about 4 inches (10.16 cm) pipe size and a bore 26 of about 6 inches (15.24 cm) pipe size. Such a cutter 10 can utilize about 5–10 Hp (3.73–7.46 Kw) at 75–100 R.P.M., depending on the character and quantity of fluid passing through the cutter or chopper 10.

The foregoing description and drawing will suggest other embodiments and variations to those skilled in the art, all of which are intended to be included in the spirit of the invention as hereinafter set forth.

That being claimed is:

1. A chopping machine comprising: (a) a hollow body defining two conduit ends adapted for connection into a flow line and defining a cylindrical bore fully intersecting the flow path between the conduit ends; (b) said bore having closure caps at both its ends with at least one of said caps being a removable cap opening to the full diameter of said bore; (c) a rotatable shaft extending axially through said bore, through one of said closure caps and adapted for rotation by an external power source; (d) a plurality of elongated rotatable cutter blades fastened transversely in splined relation to said shaft to rotate with said shaft with each said rotatable blade being angularly displaced on said shaft with respect to each adjacent rotatable blade and with each said rotatable blade extending near to the wall of said bore; (e) a plurality of elongated stationary cutter blades mounted in journaled relation on said shaft with each said stationary cutter blade being disposed adjacent a rotatable cutter blade and extending to the wall of said bore with the combination of said rotatable blades and said stationary blades being adapted to effectively intersect the complete flow path between said conduit ends; and (f) retainer means within said bore adapted to retain said stationary cutter blades against rotation; said shaft, said rotatable cutter blades and said stationary cutter blades all being removable from said body and replaceable in said body together with removal and replacement of said removable cap.

2. The machine of claim 1 wherein the section of said rotatable shaft mounting said rotatable cutter blades is of polygonal shape with the mounting holes of said cutter blades being of corresponding polygonal shape.

3. The machine of claim 1 wherein the leading edges of said rotatable cutter blades are of scythe shape.

4. The machine of claim 1 wherein said retainer means comprises at least one retainer lug extending from and along the wall of said cylindrical bore and disposed substantially parallel to the axis of said bore.

5. The machine of claim 1 wherein at least the removable cap is attached to said body with a flanged connection.

6. The chopping machine of claim 1 wherein said two conduit ends are adapted for flanged connection into a flow line.

7. The machine of claim 2 wherein said retainer means comprises at least one retainer lug extending from and along the wall of said cylindrical bore and disposed substantially parallel to the axis of said bore.

8. The machine of claim 7 wherein the leading edges of said rotatable cutter blades are of scythe shape.

9. The machine of claim 8 wherein at least the removable cap is attached to said body with a flange connection.

10. The chopping machine of claim 9 wherein said two conduit ends are adapted for flanged connection into a flow line.

* * * * *